US011248317B2

(12) United States Patent
Molteni

(10) Patent No.: US 11,248,317 B2
(45) Date of Patent: Feb. 15, 2022

(54) COVERING MACHINE

(71) Applicant: Maurizio Molteni, Treviglio (IT)

(72) Inventor: Maurizio Molteni, Treviglio (IT)

( * ) Notice: Subject to any disclaimer, the term of this patent is extended or adjusted under 35 U.S.C. 154(b) by 0 days.

(21) Appl. No.: 16/881,062

(22) Filed: May 22, 2020

(65) Prior Publication Data

US 2020/0378037 A1 Dec. 3, 2020

(30) Foreign Application Priority Data

May 27, 2019 (IT) ..... 102019000007320

(51) Int. Cl.
*D02G 3/32* (2006.01)
*D01H 1/14* (2006.01)

(52) U.S. Cl.
CPC ..... *D02G 3/32* (2013.01); *D01H 1/14* (2013.01); *D02G 3/322* (2013.01); *D10B 2401/061* (2013.01)

(58) Field of Classification Search
CPC ..... D02G 3/32; D02G 3/343; D02G 3/385; D02G 3/322; D02G 3/34; D02G 3/38; D02G 3/324; D01H 1/14; D01H 1/244
See application file for complete search history.

(56) References Cited

U.S. PATENT DOCUMENTS 2,737,773 A 3/1956 Clarkson
3,208,296 A * 9/1965 Baermann ..... F16G 1/00 474/142
3,287,892 A 11/1966 Rapoza
3,570,233 A * 3/1971 Nalpas et al. ..... D02G 3/343 57/16
3,834,143 A * 9/1974 Menegatto ..... D02G 3/385 57/16
5,916,117 A * 6/1999 Koltze ..... D01H 9/06 57/76
6,393,816 B1 * 5/2002 Hattori ..... D01H 1/16 57/100
2015/0147093 A1 * 5/2015 Mori ..... F16H 7/02 399/167
2018/0057972 A1 * 3/2018 Morrell ..... D02G 3/328

FOREIGN PATENT DOCUMENTS

FR 1489421 8/1966
WO 9205302 A1 4/1992

* cited by examiner

*Primary Examiner* — Shaun R Hurley
*Assistant Examiner* — Patrick J. Lynch
(74) *Attorney, Agent, or Firm* — Cantor Colburn LLP

(57) ABSTRACT

A machine for making covered elastic yarns, including a plurality of covering units, where each of the covering units has a spool for feeding an elastic yarn, a system for feeding a non-elastic yarn, a member for tensioning the covered elastic yarn and a bobbin for collecting the covered elastic yarn, where the system for feeding the non-elastic yarn has a microspindle which rotates about an axis and at least one bobbin for feeding the non-elastic yarn separated by and arranged upstream of the microspindle along the sliding path of the non-elastic yarn and arranged outside the rotation axis of the microspindle, the microspindle including a channel which is coaxial to the rotation axis for the passage of the elastic yarn.

9 Claims, 5 Drawing Sheets

COVERING MACHINE

CROSS REFERENCE TO RELATED APPLICATION

This application is related to and claims the benefit of Italian Patent Application Number 102019000007320 filed on May 27, 2019, the contents of which are incorporated herein by reference in their entirety.

TECHNICAL FIELD

The present disclosure relates to a spiraling machine, i.e. a machine for making elastic yarns covered by means of spiraling.

BACKGROUND

As is known, covered elastic yarns consist of a core made of elastic material on which one or more non-elastic yarns, normally neutral yarns of varying weight, are wound. These elastic yarns are used in various clothing fields, for example for the production of women's socks, leggings, trousers made of elastic fabric and the like.

The machines normally used for the production of covered elastic yarns provide systems placed in series and equipped with tens or hundreds of spiraling sections, where each of these spiraling sections comprises a vertical elastomeric yarn feeding and collection system, in which the elastomeric yarn is passed through the central section of rotating spindles where the covering yarn is unwound and, due to the rotation, it is wound on the central elastic yarn to form the covered elastic yarn. The latter is then rewound on a winding upstream. This technique produces elastic yarns with single covering or, in the case of the passage of the elastic yarn through a second non-elastic yarn spindle, elastic yarns with double covering.

The rotation of the spindles bearing the non-elastic yarn is usually carried out by means of a single drive which simultaneously transmits the motion by friction to all the spindles by means of a distribution belt which, given the extension in length of such machines, can be tens of meters long. Bearing in mind that the spindles are equipped with windings with a diameter even of 100 mm and that they must be rotated at a high speed, for example 20,000-25,000 rpm, it is easy to see how this operation requires a very high amount of energy, often forming the predominant part of the cost of the final covered elastic yarn. In some cases, this has led to a transfer of production to countries where energy costs are lower.

Other disadvantages of the known machines are related to the high levels of noise emission (usually greater than 100 db), since the aforementioned transmission of motion, occurring by tangential friction, can generate slippages due to instability, heat and various stresses. This also results in energy expenditure which significantly reduces the energy efficiency of these machines.

The dimensions of the spindles and their equipment, in addition to the inertia absorptions due to their masses, determine considerable energy absorption related to the aerodynamic frictions of both the structures and the covering yarn which, when unwinding to move about the elastic support yarn, determines the so-called "balloon" which affects a large section of air and receives a strong extension and envelope brake. Another penalizing factor of the "balloon" is the mass thereof which, when rotating about the elastomeric yarn, causes a radial load towards the latter which diverges it from the axis, until it comes into contact with the inner surface of the spindle that it crosses, which, due to the rotation, tends to twist it axially. This gives rise to a yarn with non-ideal features.

For the reasons listed above and for other reasons, the current technology allows to obtain only single or double-covered yarns, with finished yarn collection speeds of a few tens of meters per minute and with maximum angular covering speeds of no more than 20,000-25,000 rpm.

BRIEF SUMMARY

The present disclosure provides a machine for the production of covered elastic yarns which overcomes at least part of the drawbacks outlined above.

The machine for making covered elastic yarns of the disclosure is outlined in the appended claims, the definitions of which form an integral part of the present description.

Therefore, the present disclosure relates to a machine for making covered elastic yarns which has a greater energy efficiency than the machines of the prior art, so as to obtain a significant reduction in the production costs of the covered elastic yarn.

The disclosure further relates to a machine for making covered elastic yarns which allows increased productivity in terms of final covered elastic yarn.

The present disclosure further relates to a machine for making covered elastic yarns which has reduced noise emission.

The present disclosure further relates to a machine for making covered elastic yarns which allows the creation of elastic yarns with multiple coverings, i.e. with three or more covering yarns.

More in particular, the disclosure relates to a machine for making covered elastic yarns, comprising a plurality of covering units, in which each of the covering units comprises an elastic yarn feeding spool, a non-elastic yarn feeding system, a member for tensioning the covered elastic yarn and a bobbin for collecting the covered elastic yarn, where the non-elastic yarn feeding system comprises a microspindle which rotates about a vertical axis and at least one non-elastic yarn feeding bobbin separated by and arranged upstream of the microspindle along the sliding path of the non-elastic yarn and arranged outside the rotation axis of the microspindle, said microspindle comprising a channel which is coaxial to the rotation axis for the passage of the elastic yarn.

Further features and advantages of the present disclosure will become more apparent from the description of some embodiments, provided below as an indication any by way of a non-limiting example.

DETAILED DESCRIPTION

Figure 1:
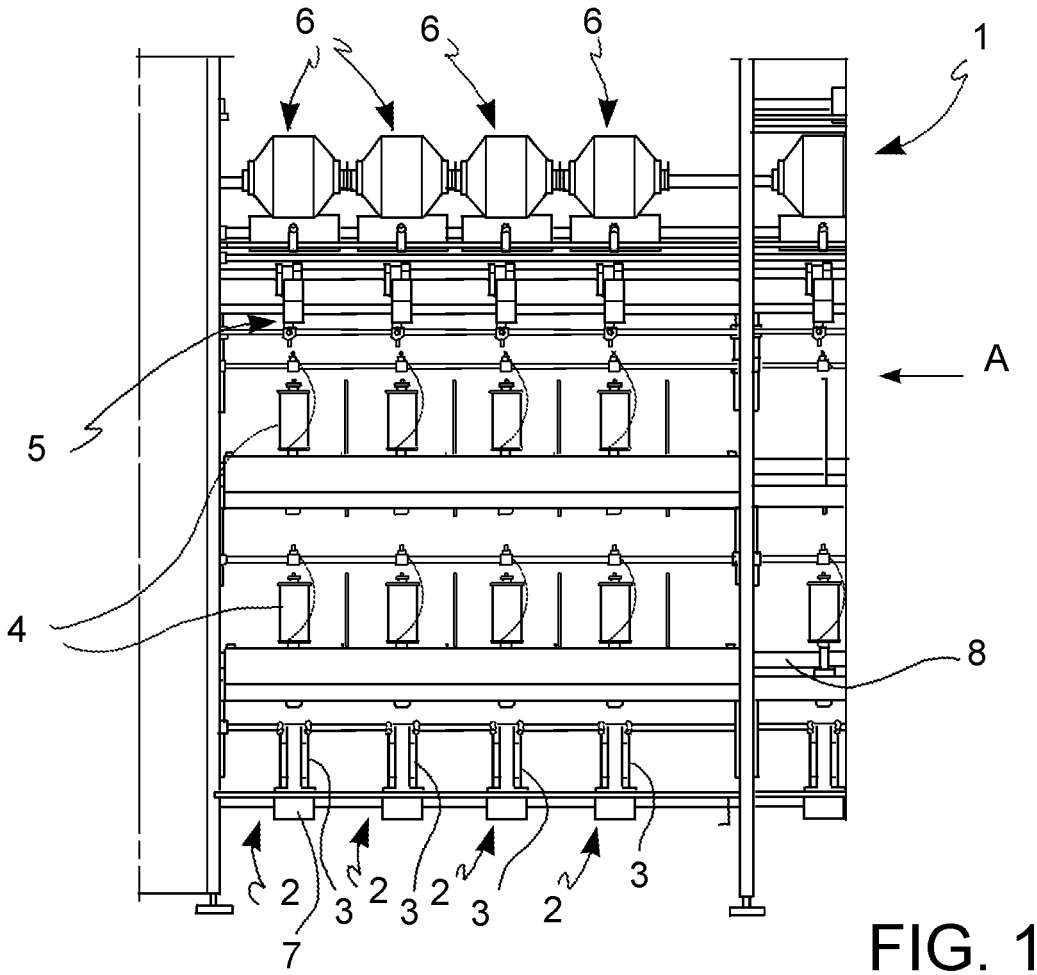
FIG. 1 (PRIOR ART)
FIG. 1 shows a front view of a detail of a spiraling machine according to the prior art.
Figure 2:
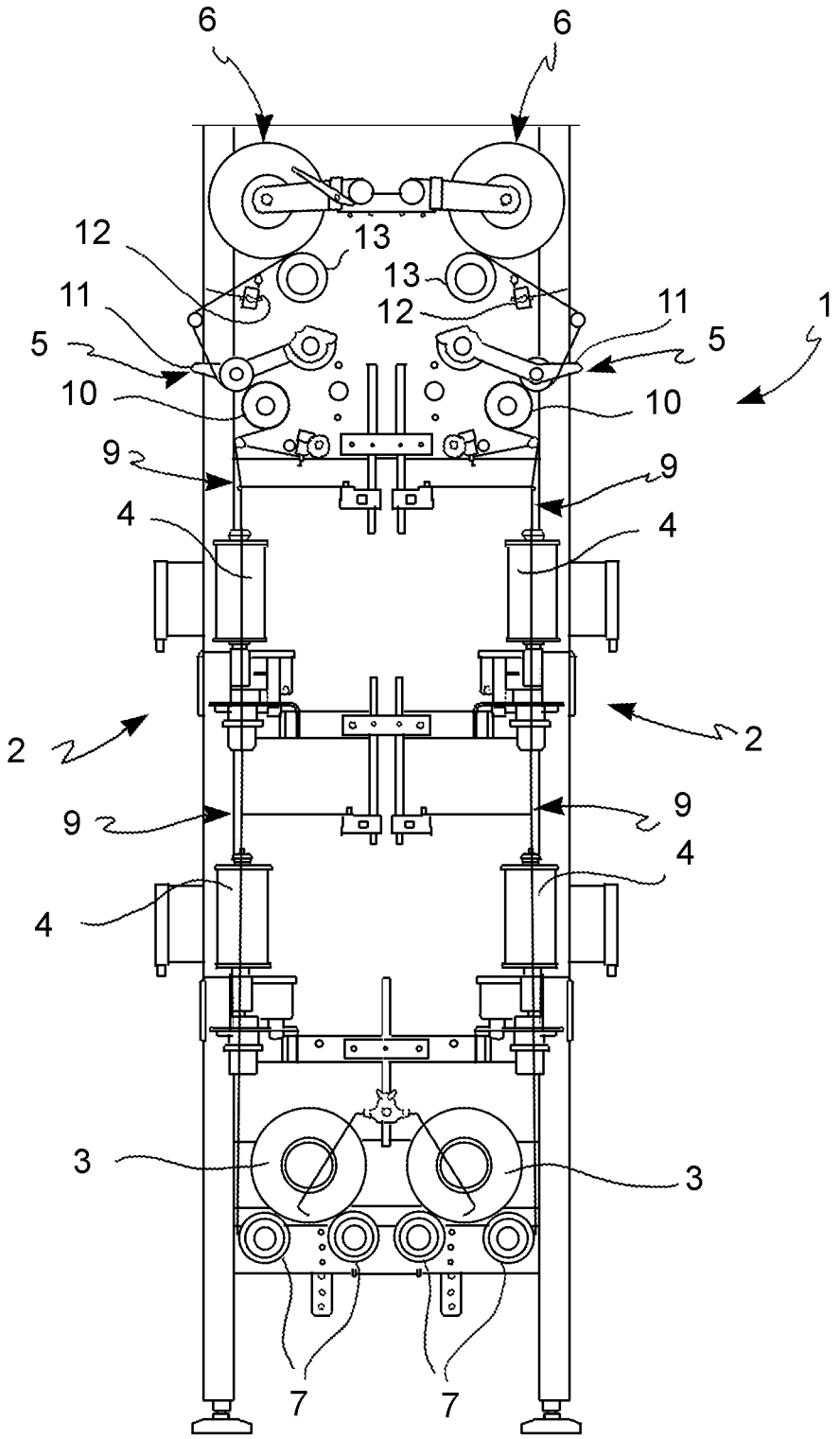
FIG. 2 (PRIOR ART)
FIG. 2 shows a side view of the spiraling machine in FIG. 1, according to the direction A in FIG. 1.

FIGS. 1 and 2 show two different views of a machine for making covered elastic yarns according to the prior art. This machine, also known as a spiraling machine and indicated as a whole by numeral 1, comprises a plurality of covering units 2, placed in parallel. Each of the covering units 2 comprises an elastic yarn feeding spool 3, at least one non-elastic yarn feeding spindle 4 (in the figures two spindles 4 are shown), a member 5 for tensioning the covered elastic yarn, and a bobbin 6 for collecting the covered elastic yarn.

As better shown in FIG. 2, the feeding spool 3 is associated with rollers 7 for moving the elastic yarn toward the non-elastic yarn feeding spindle 4, so that the elastic yarn passes coaxially inside the spindle 4.

The spindle 4 is rotated, with an angular speed, for example of 20,000-25,000 rpm, by a transmission belt 8, which connects all the spindles 4 placed in line by means of a remote drive. Thereby, the non-elastic yarn unwound by the feeding spindle 4 winds about the elastic yarn to form the covered elastic yarn.

A guide 9 for the covered yarn thus obtained is placed above the feeding spindle 4.

If the elastic yarn is to receive a second covering with a different non-elastic yarn (as in FIGS. 1 and 2), a second feeding spindle 4 and a second guide 9 are placed above the first ones. The covered elastic yarn then passes through the tensioning member 5 comprising a pulling roller 10 and a pulling arm 11. Adjusting the pulling of the elastic yarn determines the degree of elasticity of the final yarn.

The covered elastic yarn then passes through a movable yarn guide 12 with reciprocating motion along the axis of the collecting bobbin 6 on which the final yarn is wound after passing through a pressing roller 13, thus creating the so-called "traversing stroke", i.e. zig-zag winding so as to evenly distribute the yarn on the bobbin.

As previously mentioned, although both the spool 3 and the collecting bobbin 6 and the yarn guide 12 for the zig-zag windings are driven, much of the energy absorbed by the system is that required for rotating the non-elastic yarn feeding spindle 4 at a high angular speed by means of the transmission belt 8.

Figure 3:
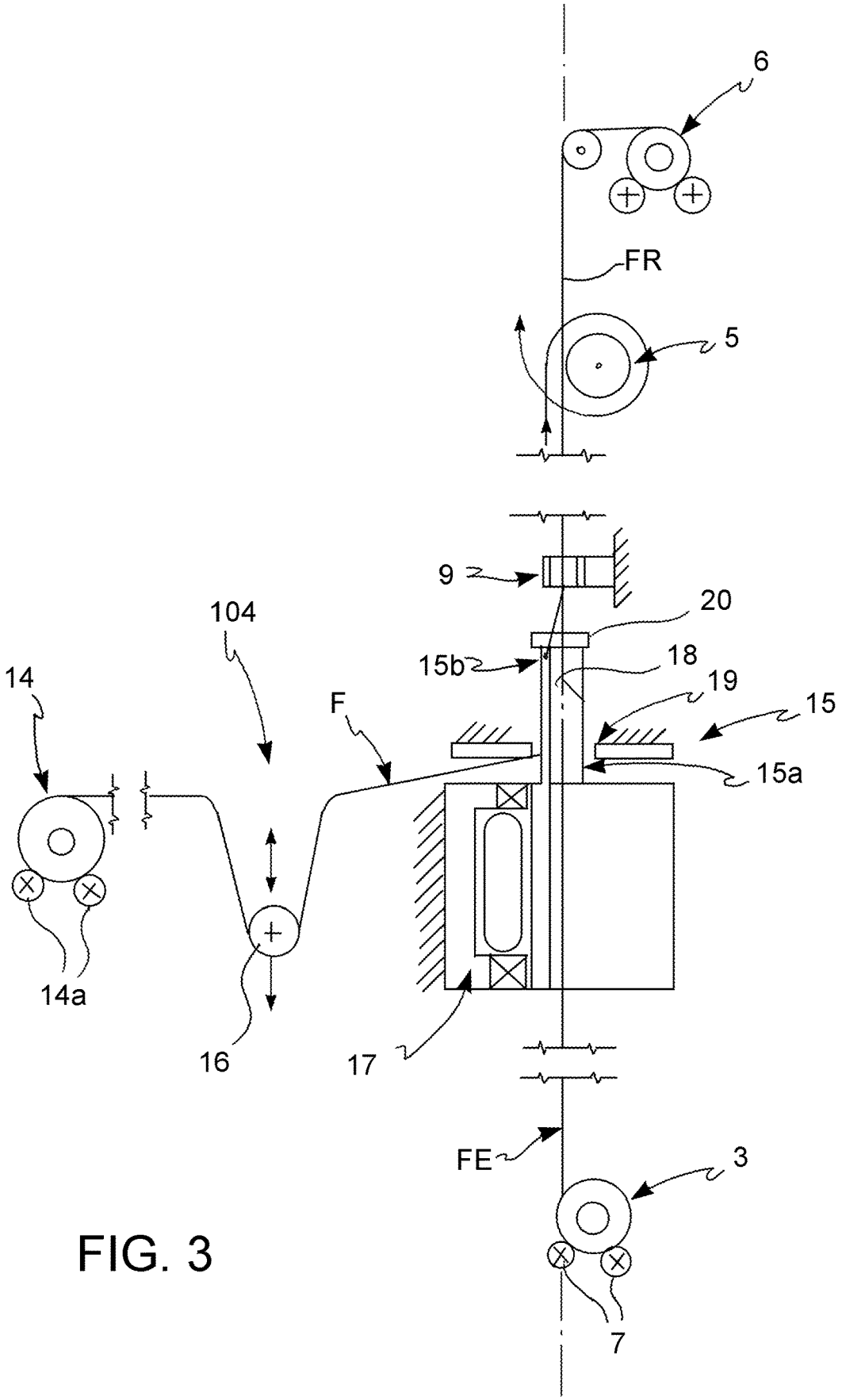
FIG. 3 shows a diagrammatic and functional sectional view of the spiraling machine of the disclosure.

With reference to FIG. 3, in which the covering unit 2 is diagrammatically shown and in which the same numbering of the parts corresponding to those of the known machine in FIGS. 1 and 2 has been maintained, the present disclosure replaces the non-elastic yarn feeding spindle 4 with a feeding system 104 which will be described below.

The feeding system 104 comprises at least one feeding bobbin 14, commonly provided with pressure rollers 14*a*, from which the non-elastic yarn F for feeding a microspindle 15 is unwound. The feeding bobbin 14 is separated from and placed upstream of the microspindle 15 along the sliding path of the non-elastic yarn F and is arranged outside the rotation axis X of the microspindle 15.

The feeding bobbin 14 is arranged with a horizontal rotation axis, but nothing prevents it from being arranged at 90°, i.e. with a vertical rotation axis.

A tensioning roller 16, vertically movable by gravity or by means of connection to a vacuum chamber, allows to obtain a constant tensioning of the non-elastic yarn F which is wound on the microspindle 15.

The elastic yarn FE, unwound by the feeding spool 3 and tensioned by the tensioning member 5 according to the methods described above for the known machines, passes through a channel 18 inside the microspindle 15 and coaxial to the rotation axis thereof.

The microspindle 15 comprises a lower portion 15*a* and an upper portion 15*b*. A yarn guide feeding ring 19 is arranged close to the lower portion 15*a*, so that the non-elastic yarn F, unwound by the feeding bobbin 14, is kept close to the rotating surface of the microspindle 15, at the base thereof, and therefore may wind about the microspindle 15.

Figure 3A:
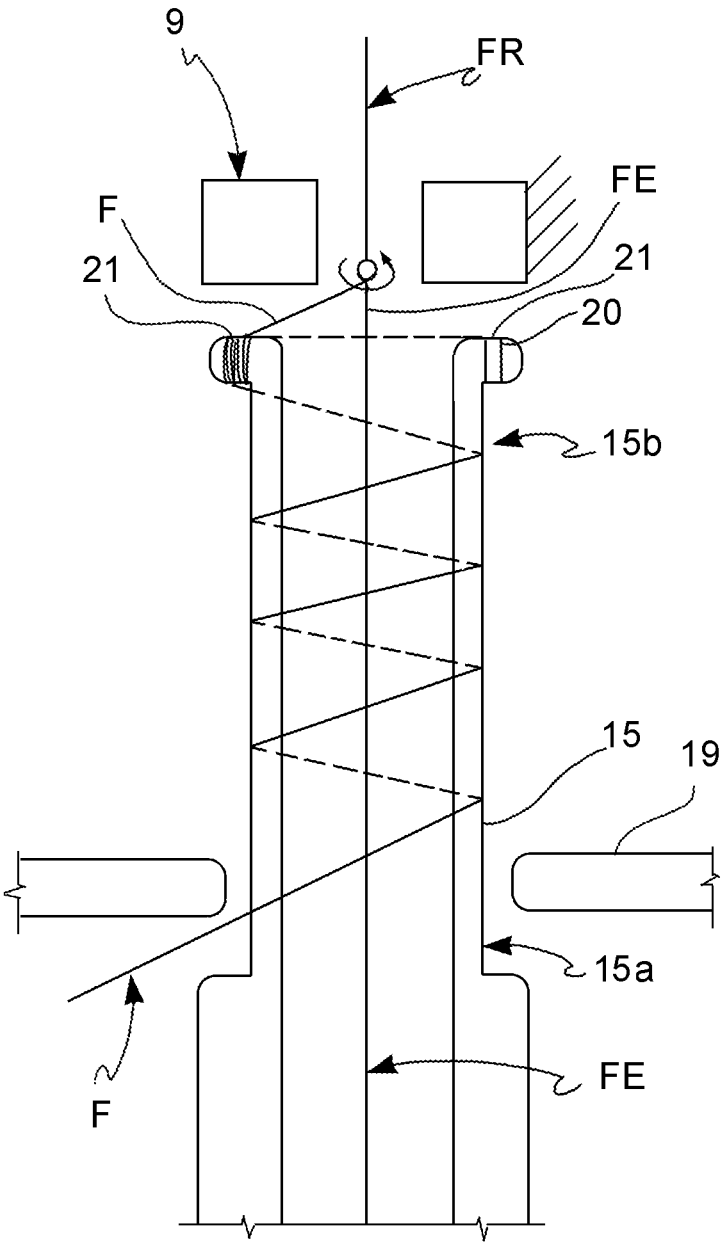
FIG. 3A shows a sectional view of a detail of the spiraling machine according to the disclosure.

As better shown in FIG. 3A, the upper portion 15*b* of the microspindle 15 comprises a flange 20 projecting outwards, in which at least one hole 21 is made for running the non-elastic yarn F, through which the yarn F is passed and thus caused to spirally wind about the elastic yarn FE which is coaxial and movable from the bottom upwards.

The upwards sliding speed of the elastic yarn FE, determined by the drive of the collecting bobbin 6, the feeding bobbin 3 and its degree of tensioning, determined by the tensioning member 5, allow to obtain covered elastic yarns FR with different structural features, as is well known to those skilled in the art.

The presence of several holes 21 for running the yarn allows the elastic yarn FE to be covered with different non-elastic yarns F, as will be better clarified below.

As in the known machines, a guide 9 for the covered elastic yarn FR is placed above the microspindle 15 which is formed therein. The yarn FR is then wound, according to the conventional methods, on the collecting bobbin 6.

The microspindle 15 comprises an independent drive 17, consisting for example of a synchronous or digital micromotor or a fluid-operated microturbine, adapted to rotate the microspindle 15 about the rotation axis X thereof.

The microspindle 15 preferably has a diameter which is less than 20 mm, preferably between 5 mm and 20 mm, and is intended to receive a minimum winding of non-elastic yarn F so that the total diameter of the microspindle 15 together with the winding of the yarn F is equivalent to the diameter of the microspindle plus twice the section of the spiraling yarn. Thereby, the masses to be rotated are minimal, which allows to obtain high energy savings while simultaneously increasing the rotation speed—which can also be greater than 100,000 rpm—and therefore the productivity of the system. It can be calculated that the machine of the disclosure allows to obtain even five times the amount of covered elastic yarn at an energy cost of about a quarter of that of the currently produced yarn.

Figure 4:
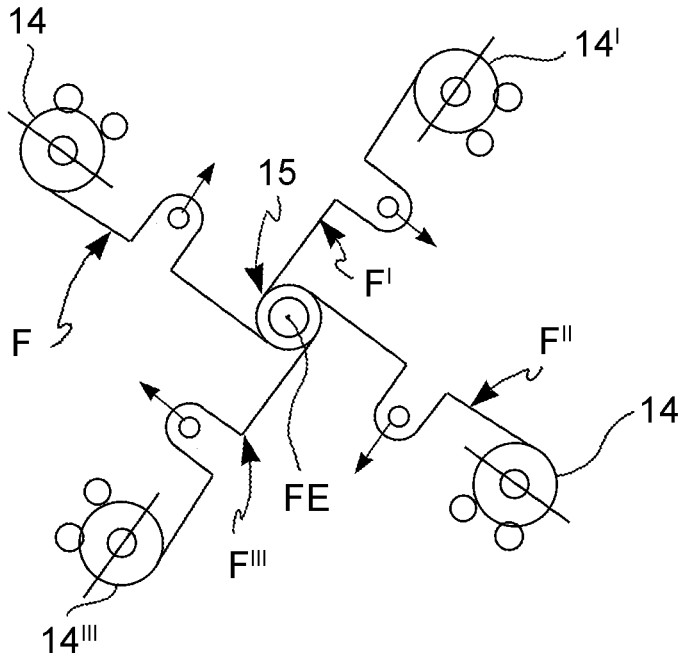
FIG. 4 shows a diagrammatic top view of a particular embodiment of the spiraling machine of the disclosure.

FIG. 4 diagrammatically shows one embodiment of the spiraling machine of the disclosure, in which there are provided, but not limited to, four feeding bobbins 14, 14', 14", 14''' of respective non-elastic yarns F, F', F", F'''. In such an embodiment, the feeding bobbins 14, 14', 14", 14''' are positioned with a vertical rotation axis at the vertexes of a square, in the middle of which the microspindle 15 is arranged. The microspindle 15 in turn will comprise four holes 21, offset 90° from one another, for running the yarn on the flange 20. The four different yarns F, F', F", F''' will then be wound first on the microspindle 15, then on the elastic yarn FE with the respective 90° offset principles. It is therefore possible to create covered elastic yarns FR with different colors or with special effects, due to the nature of the different yarns F used, until now not obtainable with the known spiraling machines.

It is apparent that, with the same expedients, it is possible to obtain a double covering, a triple covering or, in principle, even a covering with five or more yarns. If only a double covering is desired, the feeding bobbins 14, 14' may be placed at the top of a segment perpendicular and incident to the rotation axis X. In the case of three or more feeding bobbins 14, 14', 14", they may generally be arranged at the top of convenient polygons, in the middle of which the microspindle 15 is arranged.

In any case, the feeding bobbins may have either a vertical (as in FIG. 4) or horizontal (as in FIG. 3) rotation axis or even an inclined rotation axis between these two positions.

Figure 5:
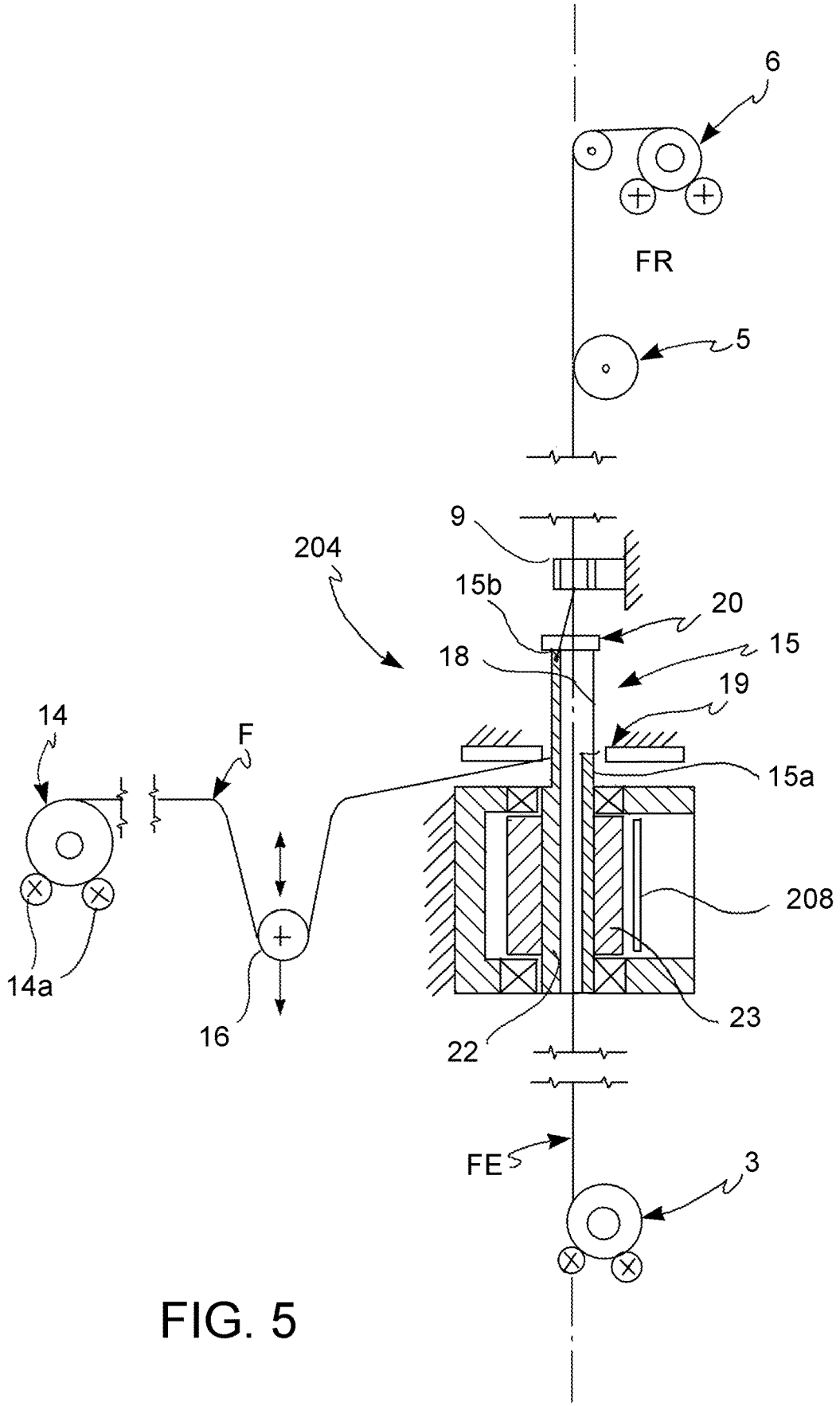
FIG. 5 shows a sectional view of a detail of a different embodiment of the spiraling machine according to the disclosure.

FIG. 5 shows, again diagrammatically, a different embodiment of the feeding system 204 of the disclosure, in which the independent drive 17 has been replaced by a remote drive which moves all the microspindles 15 placed in line in the spiraling machine 1.

In such an embodiment, the microspindle 15 comprises a coupling portion 22, arranged below the lower portion 15*a* and integral therewith. A tubular magnet 23 is arranged on the coupling portion 22. A metal belt 208 (shown in the figure in cross-section), moved by a remote drive as the belt 8 of the known spiraling machines, passes substantially tangent to and almost in contact with the tubular magnet 23. Thereby, due to the magnetic attraction, the microspindle 15 is rotated at the desired angular speed.

This embodiment, while having a common drive in place of the independent drive 17 of the first embodiment described above, solves the problems related to friction, i.e. the noise and energy dispersion present in the traditional system with in-contact belt transmission.

From the above, it is apparent that the spiraling machine of the disclosure allows to overcome the disadvantages of the known machines, and in particular achieves one or more of the following:

- high productivity of the system, related to a higher operating speed of the microspindles 15 compared to conventional spindles 4;
- lower energy consumption, due to the lower energy demand for moving the microspindles 15;
- significant abatement of noise and energy dispersion;
- possibility of obtaining covered elastic yarns FR even with three, four or more non-elastic covering yarns F.

It is apparent that only certain particular embodiments of the present disclosure have been described, to which those skilled in the art will be able to make all those modifications required for its adaptation to particular applications, without departing from the scope of protection of the present disclosure.

The invention claimed is:

1. A machine for making covered elastic yarns, comprising a plurality of covering units, wherein each of the covering units comprises a feeding spool of an elastic yarn, a feeding system of a non-elastic yarn, a tensioning member of a covered elastic yarn and a collecting bobbin of the covered elastic yarn, wherein the feeding system of the non-elastic yarn comprises a microspindle which is rotatable about a rotation axis and at least one feeding bobbin of the non-elastic yarn separated by and arranged upstream of the microspindle along a sliding path of the non-elastic yarn and arranged external to the rotation axis of the microspindle, said microspindle comprising a channel which is coaxial to the rotation axis for the passage of the elastic yarn, wherein the microspindle comprises a lower portion and an upper portion, a yarn guide feeding ring being arranged closer to the lower portion than to the upper portion, the yarn guide being configured so that the non-elastic yarn which is unwound by the feeding bobbin is kept close enough to a rotating surface of the microspindle, at a base thereof, to wind about the microspindle, and wherein the at least one feeding bobbin, comprises four feeding bobbins of respective non-elastic yarns, wherein the feeding bobbins are arranged at vertexes of a polygon.

2. The machine according to claim 1, wherein the microspindle has a diameter which is less than 20 mm and is configured to receive a minimum winding of non-elastic yarn so that a total diameter of the microspindle together with the minimum winding of the non-elastic yarn is the diameter of the microspindle plus twice a diameter of the non-elastic yarn.

3. The machine according to claim 1, wherein the upper portion of the microspindle comprises a flange, wherein at least one hole is made for running the non-elastic yarn, through which the non-elastic yarn is caused to pass and therefore to spiral wind about the elastic yarn sliding along the axis.

4. The machine according to claim 1, wherein a guide for the covered elastic yarn is arranged between the microspindle and the tensioning member.

5. The machine according to claim 1, wherein the feeding bobbins have horizontal, vertical or inclined rotation axis.

6. The machine according to claim 1, wherein the microspindle comprises an independent drive comprising a synchronous or digital micromotor or of a fluid-operated microturbine.

7. The machine according to claim 1, wherein the feeding system of the non-elastic yarn comprises a remote drive system which moves a plurality of microspindles arranged in line in the machine.

8. The machine according to claim 7, wherein each microspindle comprises a coupling portion arranged below a lower portion and integral therewith, a tubular magnet being arranged on the coupling portion, wherein a metal belt moved by a remote drive passes substantially tangent to and almost in contact with the tubular magnet of each of the in-line microspindles so as to exert a magnetic attraction thereon adapted to put the microspindles into rotation at a desired angular speed.

9. A machine for making covered elastic yarns, comprising a plurality of covering units, wherein each of the covering units comprises a feeding spool of an elastic yarn, a feeding system of a non-elastic yarn, a tensioning member of a covered elastic yarn and a collecting bobbin of the covered elastic yarn, wherein the feeding system of the non-elastic yarn comprises a microspindle which is rotatable about a rotation axis and at least one feeding bobbin of the non-elastic yarn separated by and arranged upstream of the microspindle along a sliding path of the non-elastic yarn and arranged external to the rotation axis of the microspindle, said microspindle comprising a channel which is coaxial to the rotation axis for the passage of the elastic yarn, wherein the microspindle comprises a lower portion and an upper portion, a yarn guide feeding ring being arranged closer to the lower portion than to the upper portion, the yarn guide being configured so that the non-elastic yarn which is unwound by the feeding bobbin is kept close enough to a rotating surface of the microspindle, at a base thereof, to wind about the microspindle, and wherein the at least one feeding bobbin comprises two feeding bobbins of respective non-elastic yarns, wherein the feeding bobbins are arranged at vertexes of a segment in a middle of which the microspindle is arranged.

* * * * *